United States Patent [19]

Rhyne et al.

[11] 4,103,398

[45] Aug. 1, 1978

[54] METHOD AND APPARATUS FOR BLENDING TEXTILE FIBERS

[75] Inventors: Ralph H. Rhyne; Dan S. Wise, both of Bessemer City, N.C.

[73] Assignee: Wise Industries, Inc., Bessemer City, N.C.

[21] Appl. No.: 812,514

[22] Filed: Jul. 5, 1977

[51] Int. Cl.[2] ..... D01G 13/00

[52] U.S. Cl. ..... 19/145.5

[58] Field of Search ..... 19/80 R, 81, 145.5; 177/69, 70, 71, 122; 302/4, 5, 38, 39, 28

[56] References Cited

U.S. PATENT DOCUMENTS

| | | | |
|---|---|---|---|
| 2,885,741 | 5/1959 | Leineweber, Jr. | 19/145.5 |
| 3,062,393 | 11/1962 | Bond | 19/105 X |
| 3,293,700 | 12/1966 | Smith | 19/145.5 X |
| 3,580,644 | 5/1971 | Ballard | 302/28 X |
| 3,648,330 | 3/1972 | Binder et al. | 19/145.5 |

FOREIGN PATENT DOCUMENTS

| | | | |
|---|---|---|---|
| 328,595 | 3/1972 | U.S.S.R. | 19/145.5 |

*Primary Examiner*—Dorsey Newton

*Attorney, Agent, or Firm*—Richards, Shefte & Pinckney

[57] ABSTRACT

Method and apparatus for blending textile fibers which includes simultaneously depositing a plurality of predetermined fiber loads onto a continuously moving conveyor at spaced locations thereon, providing a suction conduit at the delivery end of such conveyor for accepting the fiber loads and transporting them separately and serially to a receiver unit where the fiber loads are caused to be stacked on top of one another as separate layers on a second conveyor, and then pressing the stacked layers of fiber loads against the second conveyor while operating the second conveyor to feed the stacked layers of fiber loads edgewise against a rotating beater which simultaneously separates portions of fiber from each separate layer in the stack to provide a substantially homogeneous blend of the separated fibers.

4 Claims, 3 Drawing Figures

METHOD AND APPARATUS FOR BLENDING TEXTILE FIBERS

BACKGROUND OF THE INVENTION

Blending and doubling of the raw staple fiber stock is a primary operation in the textile industry and has been accomplished in a variety of ways. Not only is it necessary to blend and double fibers of like kind from different bales, but it has become more and more important to blend and double unlike fibers into blends with specified percentages of different fibers mixed and blended uniformly and homogeneously, and with the proportions of the different fibers held substantially constant.

The fibers are normally fed from the bales either manually or mechanically in small portions taken in sequence from many bales and deposited on the aprons of automatic hopper feeders which open, even, mix, and feed the fibers to further processing equipment. A number of such feeders disposed in a line and arranged to feed onto a horizontal conveyor is a common practice for creating blends. Each of the feeders may have a different type of fiber fed thereto and is usually equipped with a weigh pan or other measuring device which collects a predetermined weight of fibers in tufts from the feeder and holds the fibers until the weigh pans of all of the feeders have collected therein predetermined weights, or loads, of fibers. At that time, all weigh pans dump simultaneously on the conveyor, where repeated synchronized dumps form layered "sandwiches" containing suitable proportions of each different fiber for presentation to the action of a beater blender for simultaneous separation or homogenization of fibers from all layers as the sandwich is gradually fed into the beater. Various patterns or arrays of weigh pan dumps onto the conveyor have been accomplished by predetermined synchronizations of the conveyor and the weigh pans. U.S. Pat. Nos. 3,071,202, 3,080,617, and 3,439,838 disclose typical blending apparatus and methods of the aforementioned types.

U.S. Pat. No. 3,071,202 discloses a plurality of continuously running distribution conveyors which receive weigh pan loads of fibers simultaneously from a line of spaced feeders, and a collecting conveyor beneath the distribution conveyors which collects the weigh pan loads from the distribution conveyors at a rate which spreads each weigh pan load upon the collecting conveyor to form a continuous layer of fibers from each feeder and accompanying distribution conveyor on the collecting conveyor. This forms a continuous sandwich of fiber layers on the collecting conveyor, which, when fed into a beater blender, results in uniform blending of the various fibers.

A modification disclosed in the above patent eliminates the distributing conveyors and dumps the weigh pan loads directly on the collecting conveyor. However, the collecting conveyor speed must be synchronized with the weigh pan dumps so that individual "sandwiches" or stacks of layers of the different weigh pan loads are formed on the collecting conveyor and simultaneously fed into a beater blender for the intimate blending of the various fibers as desired.

U.S. Pat. No. 3,080,617 is apparently aimed toward eliminating a problem which occurs with apparatus of the type of the previously discussed U.S. Pat. No. 3,071,202. This problem consists of the typical tendency of the dumped weigh pan loads of fibers to fall onto the collecting conveyor in bunched widthwise form which does not provide even layers for the sandwich. While the different weigh pan loads may be distributed uniformly lengthwise of the collecting conveyor, the distribution across the width of the collecting conveyor is likely to be in streaks or essentially in somewhat haphazard widthwise layers rather than horizontal layers. Fibers fed from the collecting conveyor into a beater blender in this condition may result in unsatisfactory blending by the beater blender, and this patent discloses means for further mixing of these side-by-side variations of fiber content by running the partially blended fibers from the beater blender through a transversely baffled mixing chamber which re-distributes the side-wise variations of fiber blend more uniformly before conveying these further mixed fibers on a lateral conveyor to a card-like fiber processing machine for further opening, mixing, and blending. Such an arrangement requires more complicated apparatus and additional floor space.

U.S. Pat. No. 3,439,838 discloses a variation of the above-mentioned U.S. Pat. No. 3,071,202 for achieving improved blending results. This variation includes running the collecting conveyor at a sufficiently slow apeed such that successive weigh pan loads from each feeder overlap each other, whereby a continuous sandwich of fiber loads formed on the collector conveyor will contain more layers than feeders. A generally similar blending process is utilized in blending equipment manufactured by James Hunter Machine Co., Mauldin, S.C. However, even with this arrangement there may still be a non-uniformity of layers transversely of the collecting conveyor as mentioned in the preceding paragraph, and, also, the sandwich may be thicker and therefore more difficult for the beater to blend properly.

In the fiber blending apparatus of the present invention, means is provided for forming effectively continuous sandwiches of weigh pan loads of fibers which are fed to a beater blender, and the layers are substantially uniform in thickness and in weight over their entire extent, so that when processed through the beater blender, the resulting blend will have a maximum homogeneity. This improved apparatus requires a minimum of extra floor space, no complicated synchronization of collecting conveyor and feeders, and the beater blender by itself provides a highly satisfactory degree of blending without resort to an extra stage of mechanical working of the fibers.

DESCRIPTION OF THE PREFERRED EMBODIMENT

Figure 1:
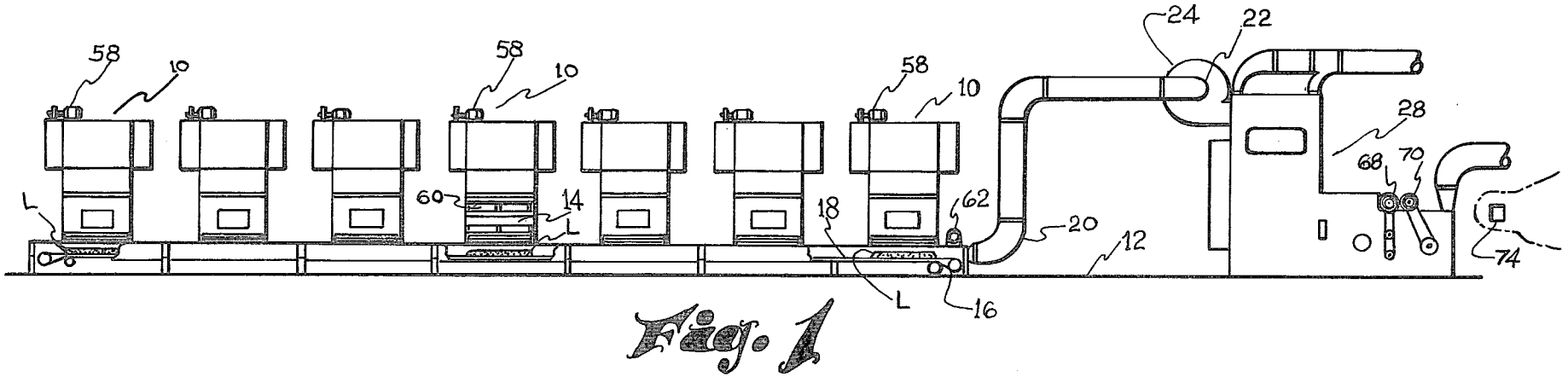
FIG. 1 is a front elevation view of blending apparatus embodying the present invention.
Figure 2:
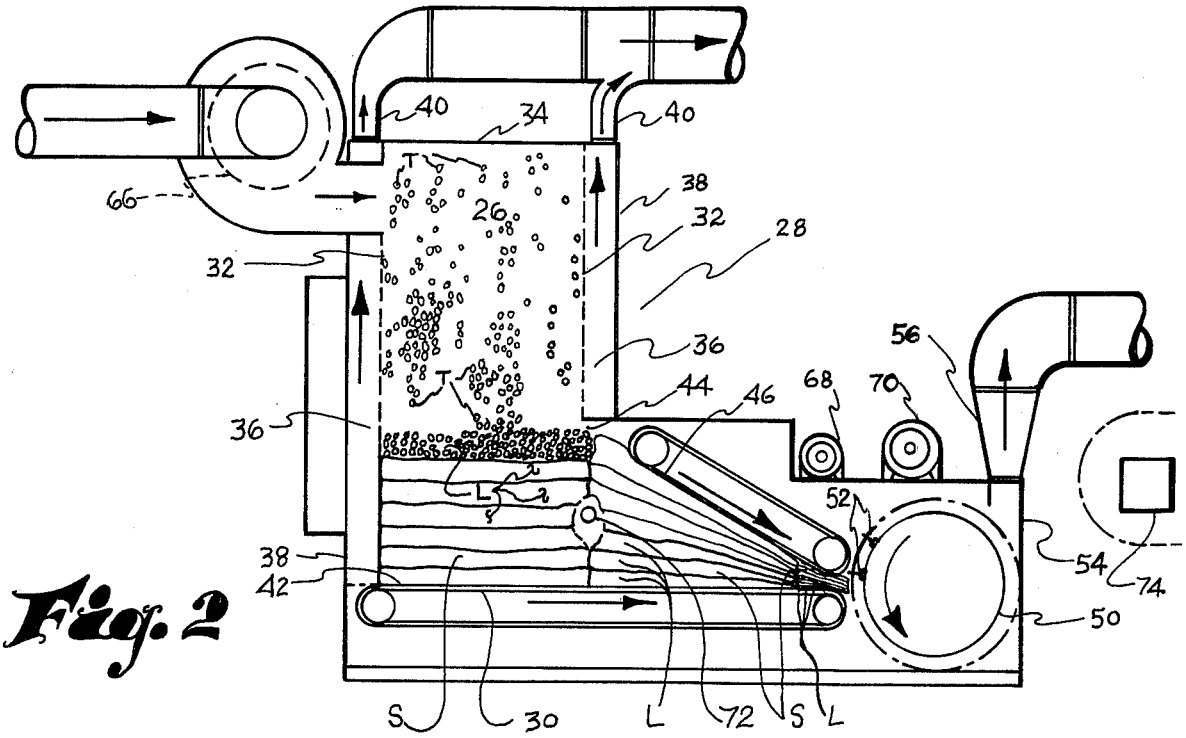
FIG. 2 is a front sectional view illustrating the receiver unit of the present invention, and related components.

Looking now in greater detail at the accompanying drawings, FIG. 1 illustrates a plurality of conventional hopper, or apron, feeders 10 set on a textile mill floor 12 and having associated weigh pans 14 overhanging a belt conveyor 16. The conveyor 16 is operated continuously to cause its top surface 18 to move toward a suction pipe or conduit 20 which is disposed adjacent the delivery end thereof and which is connected to the suction inlet 22 of a blower 24. The blower 24 is disposed to blow into the upper portion 26 of a receiver unit 28 as best shown in FIG. 2. The receiver unit 28 is provided with a feeding conveyor 30 at the bottom thereof, a top enclosing wall 34, and vertically extending side walls 38. Perforated screens 32 extend vertically in spaced relation to the side walls 38 to form a vertical chute above a portion of the conveyor 30, and to provide plenum chambers 36 between the screens 32 and the side walls 38, the air in the plenum chambers 36 being evacuated through exhaust ducts 40 which may be connected to any convenient vacuum source such as the existing air and filter system (not shown) usually found in textile mills.

The feeding conveyor 30 includes an upper horizontal reach presenting a surface 42 which, as will be explained in greater detail below, is selectively operable to move toward the right in FIG. 2. The right screen 32 shown in FIG. 2 extends only partially downwardly toward the conveyor 30, leaving an opening 44 above the conveyor 30. A portion of the conveyor 30 extends horizontally beyond the confines of the chute formed by the screens 32, and a compressing conveyor 46 is disposed above this portion of the conveyor 30 in spaced, conveying relation therewith to extend substantially from the opening 44 to the end of the conveyor 30, whereby the two conveyors 30 and 46 when operated together, act to compress and hold fibers located therebetween as they are fed toward the right as shown in FIG. 2.

A conventional beater roll 50 is located closely adjacent the delivery ends of the conveyors 30 and 46 and rotates in a counterclockwise direction as shown in FIG. 2, so that its radially extending peripheral beater blades 52 engage and separate textile fibers fed selectively thereto from between the conveyors 30 and 46. The beater roll 50 is mounted in an essentially air-tight housing 54 having a suction delivery pipe 56 leading therefrom for transporting the separated textile fibers to a following fiber-using process (not shown).

The feeders 10 are equipped with individual drive motors 58, and electrically operated controls therefor which are well known in the art, typical examples of which are disclosed in the previously mentioned U.S. patents. The conveyor 16 is operably connected to a drive motor 62. Conveyors 30 and 46 are operably connected to a drive motor 68, and the beater roll 50 is operably connected to a drive motor 70. Additionally, a conventional photoelectric cell 72 is disposed within the receiver unit 28 adjacent the opening 44 and is directed across the width of the conveyor 30 at approximately the vertical midpoint of the opening 44 to monitor the presence or absence of textile fibers carried on the conveyor 30.

Figure 3:
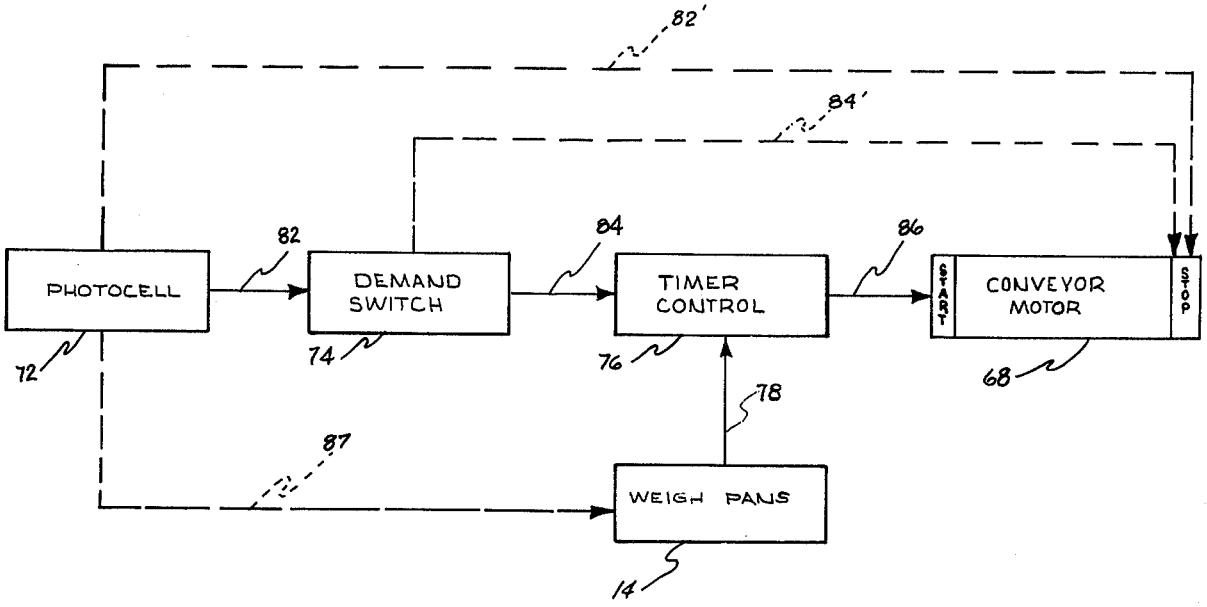
FIG. 3 is a schematic diagram of the control system of the present invention.

FIG. 3 illustrates schematically the control system for selectively operating the conveyor 30 through its motor 68, the details of the electrical circuitry included in this control system forming no part of the present invention. It will be noted in FIG. 3 that the conveyor motor 68 is controlled by the aforesaid operation of the weigh pans 14, and the photocell 72, and by a time delay control 76 and a demand switch 74 which is associated with apparatus such as a bale press (not shown) downstream of the receiver unit 28 to indicate when fibers are required or not required from the receiver unit 28. The relationship of the control components shown schematically in FIG. 3 will become apparent in connection with the following description of the operation of the present invention.

Operation

In the normal operation of the disclosed embodiment of the present invention, the entire apparatus will be turned on manually by the operating personnel using conventional manually operated electrical switches. The downstream bale press (not shown) will likewise be started up through its own control system. This initial start-up places the drive motors 62, 66 and 70 for the belt conveyor 16, the blower 24, and the beater roll 50, respectively, in continuous operation so long as the blending apparatus is turned on. This initial start-up also makes power available to the feeders 10 and weigh pans 14, and to the conveyors 30 and 46, and to the various controls therefor.

Assuming that the normal operational supply of fibers is being supplied to the feeders 10 either manually or automatically as is common in the art, and that the weigh pans 14 of the feeders 10 are empty at start-up, the operation will proceed as follows.

The weigh pans 14, as is well known in the prior art, will generate a signal calling for fibers to be deposited thereon in predetermined quantities according to the individual adjustment of each weigh pan 14, depending on the desired blend of fibers, by weight, to be achieved. At this initial start-up, the respective shut-off doors 60 of the feeders 10 will be open, so that the individual drive motors 58 of the feeders 10 will all start up and deliver fibers to their respective weigh pans 14 as is well known in the art. As each weigh pan 14 receives its respective predetermined weight or load L of fibers, each weigh pan 14 will generate a signal to cease feeding from its respective feeder 10, and the respective drive motor 58 (which is usually equipped with a brake) will be stopped, and the respective shut-off door 60 will also be closed to control the flow of fibers from the respective feeder 10.

Since the individual respective loads L for each weigh pan 14 may differ considerably, it will normally take a different length of time for each weigh pan 14 to receive its respective load L and to signal the control panel 64 that its needs have been satisfied. Therefore, as the individual feeders 10 are in turn stopped with their weigh pans loaded, they wait until the last filled weigh pan 14 generates a signal to turn off its respective feeder 10, and that signal activates a circuit which causes all of the weigh pans 14 simultaneously to dump their loads L onto the conveyor 16. Once the weigh pans have dumped, predetermined time delay relays act to reset the weigh pans 14 for receiving of fresh loads L of fibers and to restart the drive motors 58 of the respective feeders 10. Thus, a new cycle of accumulating predetermined loads L in the weigh pans 14 is commenced and continues to its normal conclusion when all weigh pans 14 have been filled with their respective predetermined loads L, and this cycle will be repeated indefinitely as demand for fibers continues. The foregoing operation of the feeders 10 and weigh pans 14 is entirely conventional.

After the weigh pans 14 have simultaneously dumped, the predetermined loads L of fibers which are thereby deposited on the conveyor 16 at spaced locations therealong will immediately be transported by the continuously running conveyor 16 toward the suction pipe 20 located at the end of the conveyor 16. Upon arrival at the suction pipe 20, each load L will be sucked away respectively as individual adhering tufts T of fibers for transport serially and separately through the suction pipe 20, through the blower 24, and into the upper portion 26 of the receiver unit 28, where the tufts T will be released into the larger air volume and slower air currents prevailing within the receiver unit 28. By their own weight, the tufts T will settle toward the bottom of the receiver 28, while the large volume of air introduced into the receiver unit 28 by the blower 24 will be dissipated at relatively low velocity through the perforated screens 32 and into the plenum chambers 36 and on through the exhaust ducts 40. The tufts T will fall toward the bottom of the chute formed by the screens 32 in a relatively undisturbed state essentially evenly distributed within the horizontal area of the chute, and they will be confined and guided in their downward travel by the screens 32 so that each predetermined load L of fibers will be stacked on top of one another as separate layers on the surface 42 of the conveyor 30 as indicated by the reference letters L in FIG. 2. It is to be noted that the conveyor 30 is in its normal condition of being stationary as the loads L of fiber are stacked thereon.

When all of the weigh pans 14 have dumped simultaneously on the conveyor 16 as described above, a control signal 78 (see FIG. 3) is transmitted from the weigh pans 14 to the timer control 76 which has a timing cycle that may be selectively pre-set to become operative after a predetermined amount of time has elapsed (e.g. approximately 15 seconds), this predetermined amount of time being selected to insure that all of the loads L of fibers will have had sufficient time to be transported by the conveyor 16 and the suction conduit 20 to the receiver unit 28 and to be stacked on the conveyor 30 as aforesaid.

As shown in FIG. 3, the timer control 76 is located in series with the photocell 72 and the demand switch 74. Whenever the photocell 72 is covered by a stack of fiber layers L on the conveyor 30, it will generate a signal 82, and whenever the demand switch 74 indicates that additional fiber is required downstream of the receiver unit 28 it will generate a signal 84. Thus, assuming that the photocell 72 is covered by a sufficient accumulation of fiber layers L stacked on the conveyor 30 and that there is a demand for fibers downstrean as reflected by demand switch 74, a "start" signal 86 will be transmitted to the conveyor motor 68 as soon as the timer control 76 has completed its pre-set timing cycle after receiving dump signal 78 from the weigh pans 14.

When the conveyor 30 is operated by its motor 68, it, together with compressing conveyor 46, will cause the fiber stacks S thereon to move toward the right to be engaged edgewise by the beater roll 50 as described above. During this movement of the conveyor 30, there can be no additional fiber feeding to the receiver unit 28 since the photocell 72 is covered and generates an effective "no dump" signal 87 that is transmitted to the weigh pans 14 (see FIG. 3) to prevent dumping thereby as long as this condition exists. Therefore, when the conveyor 30 has moved a sufficient distance for the left edge of the fiber stacks S to clear the photocell 72, its signal 82 will cease and it will, in effect, generate a "stop" signal 82' which is transmitted to the conveyor motor 68 to stop further movement of the conveyor 30. It will be noted incidentally, that a safety feature is also provided in that if there is no demand switch 74 will likewise generate an effective stop signal 84' which will also stop further movement of the conveyor 30. Once the conveyor 30 is stopped by the signal 82' the aforementioned cycle of dumping and transporting the fibers to the receiver unit 28 is repeated in cycles.

As best seen in FIG. 2, the conveyor belt 30 has a horizontal extent that is substantially greater than the length of that portion which lies directly beneath the chute formed by the screens 32 so that the conveyor 30 will hold, at any given time, two or three fiber stacks S, each resulting from one simultaneous dumping of all of the weigh pans 14. There is no defined line of demarcation between the three fiber stacks S since the adjacent edges thereof will become generally continuous, but since, in normal operation, the conveyor 30 will move during each cycle a distance corresponding to the length of each of the three stacks S, it will be seen that during each such cycle substantially one complete fiber stack S will be fed to the beater roll 50 for fiber separation thereby. Moreover, as described above, the fiber stacks S are compressed and held between the conveyor 30 and 46 as they are being fed to the beater roll 50 which simultaneously separates portions of fiber from each separate layer in a stack to achieve a thorough and homogeneous blending of such fibers.

This preferred embodiment of the present invention provides thorough and uniform blending of the fibers presented thereto with a minimum of complexity, equipment, and floor space. Quality of blending is particularly enhanced by the sucking up and redistributing into even layers of the tufts of fibers composing each predetermined load of fibers as dumped from each weigh pan. The original fiber load dumped from a weigh is not a uniform, even layer; and the prior art does not disclose any means for achieving even, uniform layers from the dumped loads prior to beating or homogenizing such non-uniform layers as they are commonly rather haphazardly stacked upon one another. The prior art has shown efforts to alleviate this problem by further doublings, and by introducing an extra stage of fiber-working, blending, or homogenizing. The preferred embodiment of the present invention acts directly to form even, uniform layers of different fibers in the desired proportions into uniform compressed stacks for presentation to the beater blender for the most advantageous homogenizing.

The present invention has been described in detail above for purposes of illustration only, and is not intended to be limited by this description or otherwise to exclude variations or equivalent arrangements of the various elements described herein, which would be apparent from or reasonably suggested by the foregoing disclosure, and the scope of the present invention is to be determined by the scope of the appended claims.

We claim:

1. Apparatus for blending textile fibers, comprising:

(a) a continuously moving and horizontally extending conveyor;

(b) a plurality of fiber depositing means positioned at spaced locations along the extend of said first conveyor surface, said plurality of fiber depositing means being selectively operable to deposit simultaneously a plurality of predetermined fiber loads on said continuously moving conveyor at spaced locations therealong;

(c) a receiver unit having a selectively movable and horizontally extending conveyor therein, and vertical side walls extending upwardly from a portion of said selectively movable conveyor to form a chute for guiding and stacking fiber on said selectively movable conveyor, said receiver unit including a compressing conveyor located in spaced angular relationship above said selectively movable conveyor for compressing and holding said stacked fibers therebetween;

(d) suction means located adjacent the delivery end of said continuously moving conveyor for accepting said plurality of fiber loads and for serially and separately delivering said fiber loads to the upper portion of said chute;

(e) a rotating beater roll associated with said receiver unit and located adjacent the delivery ends of said selectively movable conveyor and said compressing conveyor for engaging the edges of said fiber stacks delivered to said beater roll when said selectively movable conveyor and said compressing conveyor are operated; and (f) control means selectively operable to start movement of said selectively movable conveyor and said compressing conveyor after a pre-set time period following said simultaneous dumping of said plurality of fiber loads, and to stop movement of said selectively movable conveyor and said compressing conveyor after said fiber loads stacked on said selectively movable conveyor by said chute have moved a predetermined distance.

2. Apparatus for blending textile fibers, comprising:

(a) a first receiving surface having a continuous longitudinal extent;

(b) a plurality of fiber depositing means positioned at spaced locations along the extent of said first receiving surface for simultaneously depositing a plurality of predetermined fiber loads onto said first receiving surface at spaced locations therealong;

(c) receiver means including a second receiving surface for receiving fibers, a compressing surface located in spaced relation above at least a portion of said second receiving surface to cooperate therewith in compressing fibers thereon, and means for moving said second receiving surface and said compressing surface;

(d) transporting means for serially transporting said plurality of loads to said receiver means and causing said plurality of loads to be stacked on top of one another as separate layers on said second receiving surface;

(e) a rotating beater roll arranged to engage said stack of predetermined fiber loads for simultaneously separating portions of fiber from each separate layer in said stack to provide a substantially homogeneous blend of said separated fibers; and (f) control means associated with said receiver means for selectively operating said moving means to feed said stacked layers to said beater roll after said plurality of fiber loads has been stacked on said second receiving surface.

3. Apparatus for blending textile fibers according to claim 2 and further characterized in that said control means is operable to stop operation of said moving means when said plurality of fiber loads on said second receiving surface have been moved a predetermined distance by said second receiving surface.

4. A method of blending textile fibers, comprising the steps of:

(a) simultaneously depositing onto a longitudinal first surface a plurality of predetermined fiber loads at spaced locations therealong;

(b) transporting said plurality of deposited fiber loads serially and separately to a receiver having a second surface;

(c) causing said fiber loads to be stacked on top of one another as separate layers on said second surface; and (d) separating portions of fiber simultaneously from each separate layer in said stacked fiber loads by feeding said stacked fiber load layers toward separating means for simultaneous engagement of said stacked fiber load layers thereby to provide a substantially homogeneous blend of said separated fibers, said stacked fiber loads being fed to said separating means after a preset time following said simultaneous depositing of fiber loads onto said first surface, and said feeding of said stacked fiber loads to said separating means being stopped after said stacked fiber loads have advanced a predetermined distance.

* * * * *